US011199338B2

(12) United States Patent
Jones et al.

(10) Patent No.: US 11,199,338 B2
(45) Date of Patent: Dec. 14, 2021

(54) SELECTING A FALLBACK TEMPERATURE SENSOR FOR NO OCCUPANCY

(71) Applicant: Ademco Inc., Golden Valley, MN (US)

(72) Inventors: Christopher R. Jones, Minneapolis, MN (US); Derek Weller, Burnsville, MN (US); Jeffrey Boll, Brooklyn Park, MN (US); Steven R Hoglund, Minneapolis, MN (US)

(73) Assignee: Ademco Inc., Golden Valley, MN (US)

( * ) Notice: Subject to any disclaimer, the term of this patent is extended or adjusted under 35 U.S.C. 154(b) by 97 days.

(21) Appl. No.: 16/422,748

(22) Filed: May 24, 2019

(65) Prior Publication Data

US 2020/0370774 A1 Nov. 26, 2020

(51) Int. Cl.

| | |
|---|---|
| ***F24F 11/46*** | (2018.01) |
| ***F24F 11/56*** | (2018.01) |
| ***F24F 11/65*** | (2018.01) |
| ***F24F 11/64*** | (2018.01) |
| ***F24F 120/20*** | (2018.01) |
| ***F24F 120/12*** | (2018.01) |

(52) U.S. Cl.

CPC ..... *F24F 11/46* (2018.01); *F24F 11/56* (2018.01); *F24F 11/64* (2018.01); *F24F 11/65* (2018.01); *F24F 2120/12* (2018.01); *F24F 2120/20* (2018.01)

(58) Field of Classification Search

CPC .. F24F 11/46; F24F 11/65; F24F 11/56; F24F 11/64; F24F 2120/20; F24F 11/12

See application file for complete search history.

(56) References Cited

U.S. PATENT DOCUMENTS

| | | | | |
|---|---|---|---|---|
| 5,544,809 | A * | 8/1996 | Keating | F24F 11/30 236/44 C |
| 2009/0140057 | A1* | 6/2009 | Leen | F24F 11/30 236/49.3 |
| 2011/0231019 | A1* | 9/2011 | Nanami | G05B 19/042 700/277 |
| 2012/0066168 | A1* | 3/2012 | Fadell | H04L 12/2823 706/52 |

(Continued)

OTHER PUBLICATIONS

U.S. Appl. No. 16/156,954, filed Oct. 10, 2018 naming inventors: Heintzelman et al.

(Continued)

*Primary Examiner* — Kun Kai Ma

(74) *Attorney, Agent, or Firm* — Shumaker & Sieffert, P.A.

(57) ABSTRACT

In some examples, a method for controlling the heating, ventilation, and air conditioning (HVAC) system in a building includes receiving user input indicating a fallback temperature sensor from a plurality of temperature sensors in the building, the plurality of temperature sensors in the building being associated with a plurality of spaces within the building. The method also includes determining, by the controller, that the plurality of spaces within the building are unoccupied. The method further includes determining, by the controller, a temperature sensed by the fallback temperature sensor based on communication between the controller and the fallback temperature sensor. The method includes causing, by the controller, the HVAC system to turn on or off based on the temperature at the fallback temperature sensor in response to determining that the plurality of spaces within the building are unoccupied.

20 Claims, 7 Drawing Sheets

(56) References Cited

U.S. PATENT DOCUMENTS

2012/0085831 A1* 4/2012 Kopp ..... G05D 23/00 236/46 A
2012/0130547 A1 5/2012 Fadell et al.
2013/0261807 A1* 10/2013 Zywicki ..... F24F 11/30 700/278
2013/0297073 A1* 11/2013 Elwell ..... G05B 15/02 700/275
2014/0319233 A1* 10/2014 Novotny ..... G05D 23/1904 236/94
2014/0365017 A1* 12/2014 Hanna ..... F24F 11/30 700/276
2015/0167999 A1* 6/2015 Seem ..... F24F 11/30 700/276
2015/0330652 A1* 11/2015 Kim ..... F24F 11/62 700/276
2016/0085248 A1* 3/2016 Gordon ..... G05D 23/1932 700/276
2016/0245569 A1* 8/2016 Unezaki ..... G05D 23/1932
2016/0377305 A1* 12/2016 Kwa ..... F24F 11/30 700/277
2017/0074541 A1* 3/2017 Bentz ..... G06F 3/04847
2018/0023837 A1* 1/2018 Kraft ..... H04L 41/0846 700/276
2018/0114431 A1* 4/2018 Volam ..... G08B 29/12
2019/0242592 A1* 8/2019 Adamek ..... F24D 3/142

OTHER PUBLICATIONS

"C7189R2002-2/U," 2 pack RedLINK 3.0 indoor sensor, accessed from https://customer.resideo.com/en-US/Pages/Product.aspx?cat=HonECC%2520Catalog&pid=C7189R2002-2/U&category=TB7220&catpath=1.2.1.1.99%E2%80%A6 on or about Mar. 11, 2019, 1 pp.
"Programmable & Non-Programmable Thermostats For Commercial HVAC Applications," Viconics, VT7600 Series, Jun. 17, 2008, 24 pp.

* cited by examiner

SELECTING A FALLBACK TEMPERATURE SENSOR FOR NO OCCUPANCY

TECHNICAL FIELD

This disclosure relates to heating, ventilation, and air conditioning (HVAC) systems for buildings.

BACKGROUND

A heating, ventilation, and air conditioning (HVAC) system for a building controls a furnace and/or air conditioner (AC) based on a temperature in the building. The HVAC system includes one or more temperature sensors positioned throughout the building. A controller of the HVAC system can control the furnace or AC based on an average of the temperatures sensed by all of the temperature sensors. Alternatively, the controller can control the furnace or AC based on the temperature sensed at a default temperature sensor, which is often the temperature sensor inside a wall-mounted thermostat.

The HVAC system can include occupancy sensors in different rooms, where each occupancy sensor is able to sense whether a room is occupied based on motion, light, and/or heat. The controller can control the furnace or AC based on an average temperature of the occupied rooms. The controller may control the furnace or AC based on the temperature at a fallback temperature sensor in response to determining no occupancy in the building. The fallback sensor may be the same sensor as the default sensor.

SUMMARY

In general, this disclosure relates to systems, devices, and techniques for controlling a heating, ventilation, and air conditioning (HVAC) system when a controller determines no occupancy in a plurality of spaces within a building. The HVAC system includes a plurality of temperature sensors for sensing the temperature in the building. A controller can receive user input indicating a fallback temperature sensor to be used during periods of no occupancy. When the controller determines no occupancy in the building, the controller can use the temperature sensed by the fallback temperature sensor to cause the HVAC system to turn on or off. The controller can determine the temperature at the fallback temperature sensor based on a signal received from the fallback sensor.

In some examples, a method for controlling a heating, ventilation, and air conditioning (HVAC) system for a building includes receiving at a controller of the HVAC system, user input indicating a fallback temperature sensor from a plurality of temperature sensors in the building, where the plurality of temperature sensors in the building are associated with a plurality of spaces within the building. The method also includes determining, by the controller, that the plurality of spaces within the building are unoccupied and determining, by the controller, a temperature sensed by the fallback temperature sensor based on communication between the controller and the fallback temperature sensor. The method further includes causing, by the controller, the HVAC system to turn on or off based on the temperature at the fallback temperature sensor in response to determining that the plurality of spaces within the building are unoccupied.

In some examples, a controller for an HVAC system in a building includes a user interface configured to receive user input indicating a fallback temperature sensor from the plurality of temperature sensors in the building. The controller also includes processing circuitry configured to determine that the plurality of spaces within the building are occupied. The processing circuitry is also configured to determine a temperature sensed by the fallback temperature sensor based on communication between the controller and the fallback temperature sensor. The processing circuitry is further configured to cause the HVAC system to turn on or off based on the temperature at the fallback temperature sensor in response to determining that the plurality of spaces within the building are unoccupied.

In some examples, a device includes a computer-readable medium having executable instructions stored thereon, configured to be executable by processing circuitry for causing the processing circuitry to receive user input indicating a fallback temperature sensor from a plurality of temperature sensors in a building, where the plurality of temperature sensors in the building are associated with a plurality of spaces within the building. The instructions are further configured to cause the processing circuitry to determine that the plurality of spaces within the building are unoccupied and to determine a temperature sensed by the fallback temperature sensor based on communication between the device and the fallback temperature sensor. The instructions are also configured to cause the processing circuitry to control a heating, ventilation, and air conditioning system for the building based on the temperature at the fallback temperature sensor in response to determining that the plurality of spaces within the building are unoccupied.

The details of one or more examples of the disclosure are set forth in the accompanying drawings and the description below. Other features, objects, and advantages will be apparent from the description, drawings, and claims.

DETAILED DESCRIPTION

Various examples are described below for controlling a heating, ventilation, and air conditioning (HVAC) system using a plurality of sensors in a building. The plurality of sensors may be configured to sense temperature in a plurality of spaces within the building. When a controller of the HVAC system determines occupancy within the building, the controller may determine the temperature sensed by the sensors in the occupied spaces and control the HVAC system based on the determined temperature. The determination of occupancy in the building is referred to as building-level occupancy, and the determination of occupancy in a particular space within the building is referred to as room-level occupancy. For example, if the determined temperature is less than a first threshold, the controller can turn on a furnace to generate heat for the building. If the determined temperature is greater than a second threshold, the controller can turn on an air conditioner (AC) to reduce the temperature in the building.

If the controller determines that the plurality of spaces within the building are unoccupied, the controller can control the HVAC system based on the temperature sensed at a fallback temperature sensor. In some examples, the controller is programmed to use the temperature sensor that is integrated in a wall-mounted thermostat as the fallback temperature sensor. However, the thermostat may not always be located in a high-traffic area. Moreover, the thermostat may be located on a floor of the building that has a higher or lower temperature than other parts of the building. For example, the top floor of a house may have a higher temperature than the lower floor(s) of the house. In warm weather, a homeowner may want to use a temperature sensor on a lower floor as the fallback temperature sensor to lower the cost of cooling the house. In addition, there may be a space within the building where control of the temperature is more important, such as a baby's room, an indoor garden, or a server room.

In accordance with the techniques of this disclosure, a controller may be configured to receive user input indicating a fallback temperature sensor from a plurality of temperature sensors. The user can select the fallback temperature sensor for use when the controller determines that the plurality of spaces within the building are unoccupied. The controller will then control the HVAC system based on the temperature at the selected fallback temperature sensor when the controller determines that the plurality of spaces are unoccupied. The selection of the fallback temperature sensor allows the user to control the temperature in a specific space or room within the building, which can be important for cost savings, overall building comfort, or other reasons.

Figure 1:
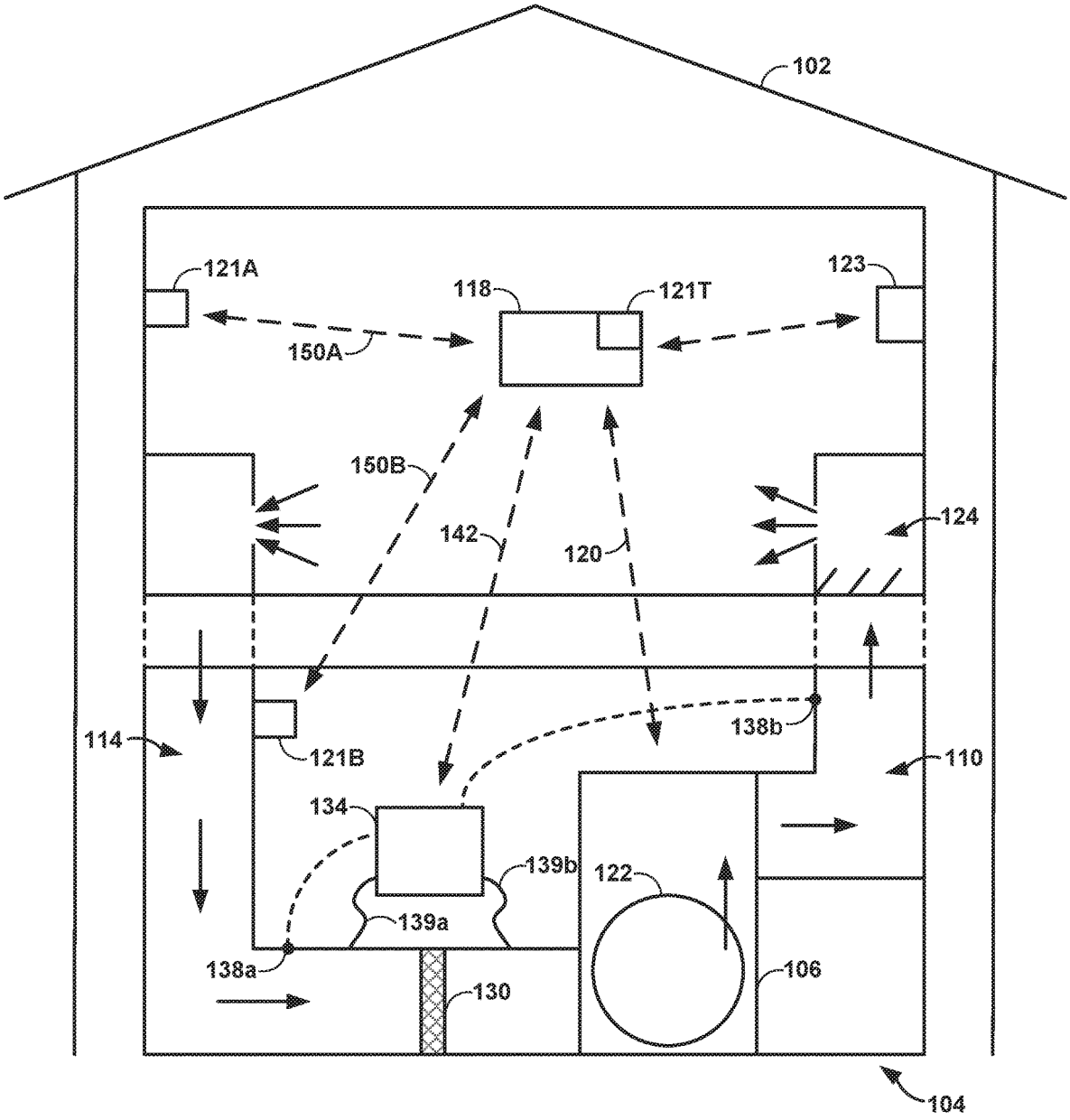
FIG. 1 is a diagram of a heating, ventilation, and air conditioning (HVAC) system in a building, in accordance with some examples of this disclosure.

FIG. 1 is a diagram of an HVAC system 104 in a building 102, in accordance with some examples of this disclosure. HVAC system 104 includes HVAC component 106, a system of ductwork and air vents including supply air duct 110 and a return air duct 114, and controller 118. HVAC component 106 may include, but is not limited to, a furnace, a heat pump, an electric heat pump, a geothermal heat pump, an electric heating unit, an AC unit, a humidifier, a dehumidifier, an air exchanger, an air cleaner, a damper, a valve, a fan, and/or the like.

Controller 118 may be configured to control the comfort level (e.g., temperature and/or humidity) in building 102 by activating and deactivating HVAC component 106 in a controlled manner. Controller 118 may be configured to control the HVAC component 106 via a wired or wireless communication link 120. Controller 118 may be a thermostat, such as, for example, a wall mountable thermostat. The thermostat may include (e.g. within the thermostat housing) or have access to sensor 121T for sensing ambient temperature at or near the thermostat. In some instances, controller 118 may be a zone controller, or may include multiple zone controllers each monitoring and/or controlling the comfort level within a particular zone (e.g., a particular space) in building 102.

Controller 118 may communicate with remote sensors 121A and 121B that are disposed within building 102. In some cases, a remote sensors 121A and 121B may measure various environmental conditions such as but not limited to temperature, humidity, carbon dioxide levels, motion, light, heat (e.g., an infrared sensor), and/or sound. In some examples, remote sensors 121A and 121B include combined sensors that can sense temperature, humidity, and motion. In other words, remote sensor 121A can include a temperature sensor and an occupancy sensor integrated into a single device. Additionally or alternatively, remote sensor 121B may include only a temperature sensor that is not capable of sensing motion. Communication channels 150A and 150B between controller 118 and remote sensors 121A and 121B may include wired and/or wireless communication channels, such as Wi-Fi, Bluetooth, Zigbee, Universal Serial Bus (USB), ethernet, and/or any other type of communication channel. Through communication channels 150A and 150B, sensors 121A and 121B can communicate the temperature, humidity, motion, and/or occupancy sensed by sensors 121A and 121B to controller 118. Sensor 121T can communicate the temperature, humidity, motion, and/or occupancy sensed by sensor 121T to controller 118 through another communication channel that is not shown in FIG. 1.

Sensor 121T, which is integrated into controller 118, is located in a first space within building 102. The first space may be, for example, a kitchen or a living room of a house. Sensor 121A is located in a second space within building 102, which may be a bedroom in the house, as an example. Sensor 121B is located in a third space within building 102, which may be a basement or a mechanical room of the house. Each of sensors 121A, 121B, and 121T may be configured to sense temperature, humidity, motion, and/or any other environmental parameters.

HVAC component 106 may provide heated air (and/or cooled air) via the ductwork throughout the building 102. As illustrated, HVAC component 106 may be in fluid communication with every space, room, and/or zone in building 102 via ductwork 110 and 114, but this is not required. In operation, when controller 118 provides a heat call signal, HVAC component 106 (e.g. a forced warm air furnace) may turn on (begin operating or activate) to supply heated air to one or more spaces within the building 102 via supply air ducts 110. HVAC component 106 and blower or fan 122 can force the heated air through supply air duct 110. In this example, the cooler air from each space returns to HVAC component 106 (e.g. forced warm air furnace) for heating via return air ducts 114. Similarly, when a cool call signal is provided by controller 118, HVAC component 106 (e.g., an AC unit) may turn on to supply cooled air to one or more spaces within building 102 via supply air ducts 110. HVAC component 106 and blower or fan 122 can force the cooled air through supply air duct 110. In this example, the warmer air from each space of building 102 may return to HVAC component 106 for cooling via return air ducts 114. In some examples, HVAC system 104 may include an internet gateway or other device 123 that may allow one or more of the HVAC components to communicate over a wide area network (WAN) such as, for example, the Internet.

The system of vents or ductwork 110 and/or 114 can include one or more dampers 124 to regulate the flow of air, but this is not required. For example, one or more dampers 124 may be coupled to controller 118, and can be coordinated with the operation of HVAC component 106. Controller 118 may actuate dampers 124 to an open position, a closed position, and/or a partially open position to modulate the flow of air from the one or more HVAC components to an appropriate room and/or space in building 102. Dampers 124 may be particularly useful in zoned HVAC systems, and may be used to control which space(s) in building 102 receive conditioned air and/or receives how much conditioned air from HVAC component 106. In some cases, controller 118 may use information from remote sensors 121A and 121B to adjust the position of one or more of dampers 124 in order to cause a measured value (e.g., temperature or humidity) to approach a set point in a particular space.

In many instances, air filters 130 may be used to remove dust and other pollutants from the air inside the building 102. In the example shown in FIG. 1, air filter 130 is installed in return air duct 114 and may filter the air prior to the air entering HVAC component 106, but it is contemplated that any other suitable location for air filter 130 may be used. The presence of air filter 130 may not only improve the indoor air quality but may also protect the HVAC component 106 from dust and other particulate matter that would otherwise be permitted to enter HVAC component 106.

HVAC system 104 includes equipment interface module 134. When provided, the equipment interface module 134 may, in addition to controlling the HVAC under the direction of the thermostat, be configured to measure or detect a change in a given parameter between the return air side and the discharge air side of the HVAC system 104. For example, equipment interface module 134 may measure a difference (or absolute value) in temperature, flow rate, pressure, or a combination of any one of these parameters between the return air side and the discharge air side of HVAC system 104. In some instances, absolute value is useful in protecting equipment against an excessively high temperature or an excessively low temperature, for example. In some cases, equipment interface module 134 may be adapted to measure the difference or change in temperature (delta T) between a return air side and discharge air side of HVAC system 104 for the heating and/or cooling mode. The delta T for the heating and cooling modes may be calculated by subtracting the return air temperature from the discharge air temperature (e.g. delta T=discharge air temperature–return air temperature).

In some examples, equipment interface module 134 includes temperature sensor 138*a* located in return (incoming) air duct 114 and temperature sensor 138*b* located in discharge (outgoing or supply) air duct 110. Alternatively, or in addition, equipment interface module 134 may include a differential pressure sensor including pressure tap 139*a* located in the return (incoming) air duct 114. Equipment interface module 134 may also include pressure tap 139*b* located downstream of air filter 130 to measure a change in a parameter related to the amount of flow restriction through air filter 130. In some cases, it can be useful to measure pressure across the fan in order to determine if too much pressure is being applied as well as to measure pressure across the cooling A-coil in order to determine if the cooling A-coil may be plugged or partially plugged. In some examples, equipment interface module 134, when provided, may include at least one flow sensor that is capable of providing a measure that is related to the amount of air flow restriction through air filter 130. In some examples, equipment interface module 134 may include an air filter monitor.

When provided, equipment interface module 134 may be configured to communicate with controller 118 via, for example, wired or wireless communication link 142. In other cases, equipment interface module 134 may be incorporated or combined with controller 118. In some instances, equipment interface module 134 may communicate, relay or otherwise transmit data regarding the selected parameter (e.g. temperature, pressure, flow rate, etc.) to controller 118. In some cases, controller 118 may use the data from equipment interface module 134 to evaluate the system's operation and/or performance. For example, controller 118 may compare data related to the difference in temperature (delta T) between the return air side and the discharge air side of HVAC system 104 to a previously determined delta T limit stored in controller 118 to determine a current operating performance of HVAC system 104. In other cases, equipment interface module 134 may itself evaluate the system's operation and/or performance based on the collected data.

Controller 118 can receive user input indicating one of sensors 121A, 121B, and 121T as a fallback temperature sensor. A user may be able to select any of the temperature sensors in building 102 as the fallback temperature sensor through a user interface of controller 118. In response to determining that the spaces within building 102 are unoccupied, controller 118 may be configured to control HVAC component 106 based on the temperature sensed at the fallback temperature sensor.

Controller 118 can determine that the spaces within building 102 are unoccupied using various techniques. For example, controller 118 can determine building-level occupancy for building 102 by determining whether the signals received from each of a plurality of sensors indicate that no motion, occupancy, and/or light has been sensed for a threshold duration of time. Controller 118 can determine building-level occupancy based on the determination of room-level occupancy for spaces within building 102. In some examples, controller 118 determines room-level occupancy when the motion, heat, or light sensed in that room is greater than a threshold level.

Additionally or alternatively, controller 118 can determine building-level occupancy for building 102 by determining that an alarm has been set to an away status or an unoccupied status. Controller 118 can determine that building 102 is unoccupied by using geo-fencing, by determining that no mobile phones are connected to a wireless network, and/or based on the time of day and day of week. Controller 118 may be programmable to assume occupancy during a particular time of day (e.g., 6:00 to 10:00 p.m. every day) and/or no occupancy during another time of day (e.g., 10:00 a.m. to 4:00 p.m. Monday through Friday).

Controller 118 may be configured to determine room-level occupancy and building-level occupancy. Controller 118 can determine building-level occupancy based on a determination of room-level occupancy, or controller 118 can determine room-level occupancy after determining that building 102 is occupied. Controller 118 can use alarm status, geo-fencing, wireless networks, user input to determine building-level occupancy. Controller 118 can use occupancy sensors or electrical lights to determine room-level occupancy. For example, controller 118 can determine that a room is unoccupied in response to determining that the lights in the room are turned off. Controller 118 can also use user input and other programmed assumptions (e.g., assume bedrooms are occupied from 10:00 p.m. to 6:00 a.m.) to determine room-level occupancy. In response to determining that building 102 is occupied, controller 118 can determine which of the rooms in building 102 are occupied. Controller 118 can also determine building-level occupancy by determining that at least one space in building 102 is occupied.

In response to determining occupancy by determining motion near sensor 121A, controller 118 may be configured to control HVAC component 106 based on the temperature sensed by sensor 121A. In response to determining occupancy by determining motion near sensor 121A and near sensor 121T, controller 118 may be configured to control HVAC component 106 based on an average of the temperature sensed by sensor 121A and the temperature sensed by sensor 121T. Controller 118 can determine occupancy or no occupancy by determining motion at each of sensors 121A, 121B, and 121T based on signals received by controller 118 through communication channels 150A and 150B, as well as the communication channel between controller 118 and sensor 121T. Controller 118 can determine motion at sensor 121A based on a signal received by controller 118 from sensor 121A through communication channel 150A. In some examples, there may be an additional communication channel between sensors 121A and 121B, such that sensor 121A could relay information received from sensor 121B to controller 118.

Controller 118 may continue to receive signals from sensors 121A, 121B, and 121T. In response to receiving signals from all of sensors 121A, 121B, and 121T indicating that no motion or occupancy has been sensed, controller 118 may be configured to set a timer. In response to determining that the timer has reached a threshold duration of time after being set, and in response to receiving signals from sensors 121A, 121B, and 121T indicating that no motion or occupancy has been sensed since controller 118 set the timer, controller 118 may be configured to control HVAC component 106 based on the temperature sensed at the fallback temperature sensor. In response to determining that a sensor has sensed motion or occupancy before the time reaches the threshold duration of time, controller 118 may reset the timer and control HVAC component 106 based on a default control scheme. The default control scheme may be based on an average of the temperature at the occupied sensor(s) or the temperature at the default sensor(s).

Controller 118 may include any suitable arrangement of hardware, software, firmware, or any combination thereof, to perform the techniques attributed to controller 118 herein. Examples of controller 118 include any one or more microprocessors, digital signal processors (DSPs), application specific integrated circuits (ASICs), field programmable gate arrays (FPGAs), or any other equivalent integrated or discrete logic circuitry, as well as any combinations of such components. When controller 118 includes software or firmware, controller 118 further includes any necessary hardware for storing and executing the software or firmware, such as one or more processors or processing units.

In general, a processing unit may include one or more microprocessors, DSPs, ASICs, FPGAs, or any other equivalent integrated or discrete logic circuitry, as well as any combinations of such components. Although not shown in FIG. 1, controller 118 may include a memory configured to store data. The memory may include any volatile or non-volatile media, such as a random access memory (RAM), read only memory (ROM), non-volatile RAM (NVRAM), electrically erasable programmable ROM (EEPROM), flash memory, and the like. In some examples, the memory may be external to controller 118 (e.g., may be external to a package in which controller 118 is housed).

Controller 118 may also include a memory for storing sensed temperatures, sensed humidity, temperature and humidity set points, fallback temperature sensors, default sensors, locations of sensors, threshold levels, and/or any other data. In some examples, the memory may store program instructions, which may include one or more program modules, which are executable by controller 118. When executed by controller 118, such program instructions may cause controller 118 to provide the functionality ascribed to it herein. The program instructions may be embodied in software, firmware, and/or RAMware. The memory may include any volatile, non-volatile, magnetic, optical, or electrical media, such as a random access memory (RAM), read-only memory (ROM), non-volatile RAM (NVRAM), electrically-erasable programmable ROM (EEPROM), flash memory, or any other digital media.

Figure 2:
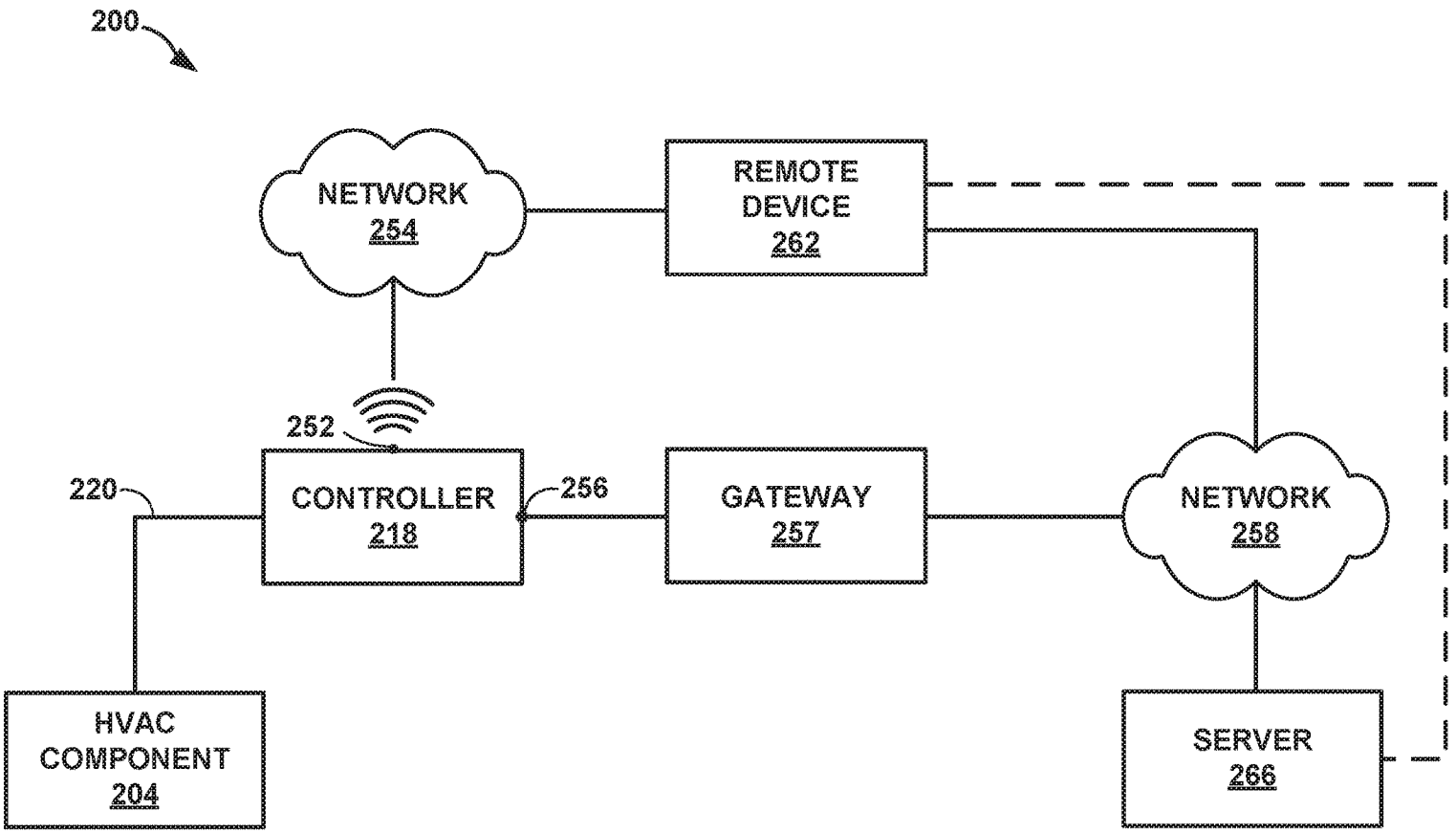
FIG. 2 is a conceptual block diagram of an HVAC control system, in accordance with some examples of this disclosure.

FIG. 2 is a conceptual block diagram of an HVAC system 200, in accordance with some examples of this disclosure. FIG. 2 shows an example of remote access and/or control of HVAC system 200, which may be part of a building automation system. HVAC system 200 includes controller 218 configured to communicate with and control HVAC component 206 of HVAC system 200. Controller 218 may communicate with HVAC component 206 via wired or wireless communication link 220. Additionally, controller 218 may communicate over one or more wired or wireless networks that may accommodate remote access and/or control of controller 218 via another device such as a smart phone, tablet, e-reader, laptop computer, personal computer, key fob, or the like.

As shown in FIG. 2, controller 218 may include communications port 252 for communicating over network 254, and in some cases, communications port 256 for communicating over network 258. In some cases, network 254 may be a wireless local area network (LAN), and network 258 (when provided) may be a WAN or global network including, for example, the Internet. Gateway 257 connects communications port 256 to network 258, where gateway 257 can include a modem, an ethernet router, and/or a Wi-Fi router. In some cases, network 254 may provide a wireless access point and/or a network host device that is separate from controller 218. In other cases, network 254 may provide a wireless access point and/or a network host device that is part of controller 218. In some examples, network 254 includes a local domain name server (DNS). Network 254 may be an ad-hoc wireless network.

In some cases, controller 218 may be programmed to communicate over network 258 with an external web service hosted by one or more external web server(s) 266. An example of such an external web service is Honeywell's TOTAL CONNECT™ web service. Controller 218 may be configured to upload selected data via network 258 to the external web service where it may be collected and stored on server 266. In some cases, the data may be indicative of the performance of HVAC system 200. Additionally, controller 218 may be configured to receive and/or download selected data, settings and/or services sometimes including software updates from the external web service over network 258. The data, settings and/or services may be received automatically from the web service, downloaded periodically in accordance with a control algorithm, and/or downloaded in response to a user request. In some examples, controller 218 is configured to receive and/or download an HVAC operating schedule and operating parameter settings such as, for example, temperature set points, humidity set points, start times, end times, schedules, window frost protection settings, threshold levels, and/or the like from server 266 over network 258. In some examples, controller 218 is configured to receive one or more user profiles having at least one operational parameter setting that is selected by and reflective of a user's preferences. In still other instances, controller 218 may be configured to receive and/or download firmware and/or hardware updates such as, for example, device drivers from server 266 over network 258.

Depending upon the application and/or where the HVAC user is located, remote access and/or control of controller 218 may be provided over network 254 and/or network 258. A user can access and/or control controller 218 from a remote location (e.g. remote from controller 218) over network 254 and/or network 258 using remote device 262. Remote device 262 including, but not limited to, mobile phones including smart phones, tablet computers, laptop or personal computers, wireless network-enabled key fobs, e-readers, and/or the like. In many cases, remote device 262 is configured to communicate wirelessly over network 254 and/or network 258 with controller 218 via one or more wireless communication protocols including, but not limited to, cellular communication, ZigBee, REDLINK™, Bluetooth, WiFi, IrDA, dedicated short range communication (DSRC), EnOcean, and/or any other suitable common or proprietary wireless protocol, as desired. In some cases, remote device 262 may communicate with network 254 via server 266 for security purposes, for example.

In some cases, an application program code stored in the memory of the remote device 262 may be used to remotely access and/or control controller 218. The application program code may be downloaded from an external web service, such as the web service hosted by the external web server 266 (e.g. Honeywell's TOTAL CONNECT™ web service) or another external web service (e.g. ITUNES® or Google Play). In some cases, the application may provide a remote user interface for interacting with controller 218 at remote device 262. For example, through the user interface provided by the application, a user may be able to change operating parameter settings such as, for example, temperature set points, humidity set points, start times, end times, schedules, window frost protection settings, accept software updates and/or the like. Communications may be routed from remote device 262 to server 266 and then, from server 266 to controller 218. In some cases, communications may flow in the opposite direction such as, for example, when a user interacts directly with controller 218 to change an operating parameter setting such as, for example, a schedule change or a set point change. The change made at controller 218 may be routed to server 266 and then from server 266 to remote device 262 where the application program executed by remote device 262 can present the information to a user.

In some cases, a user may be able to interact with controller 218 via a user interface provided by one or more web pages hosted by server 266. The user may interact with the one or more web pages using a variety of internet capable devices to change a setting or other parameter at controller 218, and in some cases view usage data and energy consumption data related to the usage of HVAC system 200. In some cases, communication may occur between remote device 262 and controller 218 without being relayed through server 266.

A user can select a fallback temperature sensor using controller 218 or remote device 262, which is connected to controller 218 via network 254 and/or 258. Controller 218 or remote device 262 can run an application that presents a user interface to the user, where the user interface prompts the user to select the fallback temperature sensor from a plurality of sensors in HVAC system 200. For example, controller 218 or remote device 262 can present text and/or audio prompting the user to select a fallback temperature sensor from a list of sensors in HVAC system 200. Controller 218 or remote device 262 can provide a name and/or a location for each temperature sensor to the user. Additionally or alternatively, controller 218 or remote device 262 can present an image of a building showing the locations of the temperature sensors for the user to select one of the temperature sensors.

By providing user input to controller 218 or remote device 262, a user can select a fallback temperature sensor from the plurality of sensors of HVAC system 200. The user can provide the user input by clicking a button, pressing a key, touching a touchscreen, clicking a mouse, or by entering text. The user can also provide audio user input through a voice command. In examples in which remote device 262 receives the user input, remote device 262 can transmit the selection made by the user to controller 218. Controller 218 can store the selection to memory for when controller 218 determines that the building is unoccupied.

Figure 3:
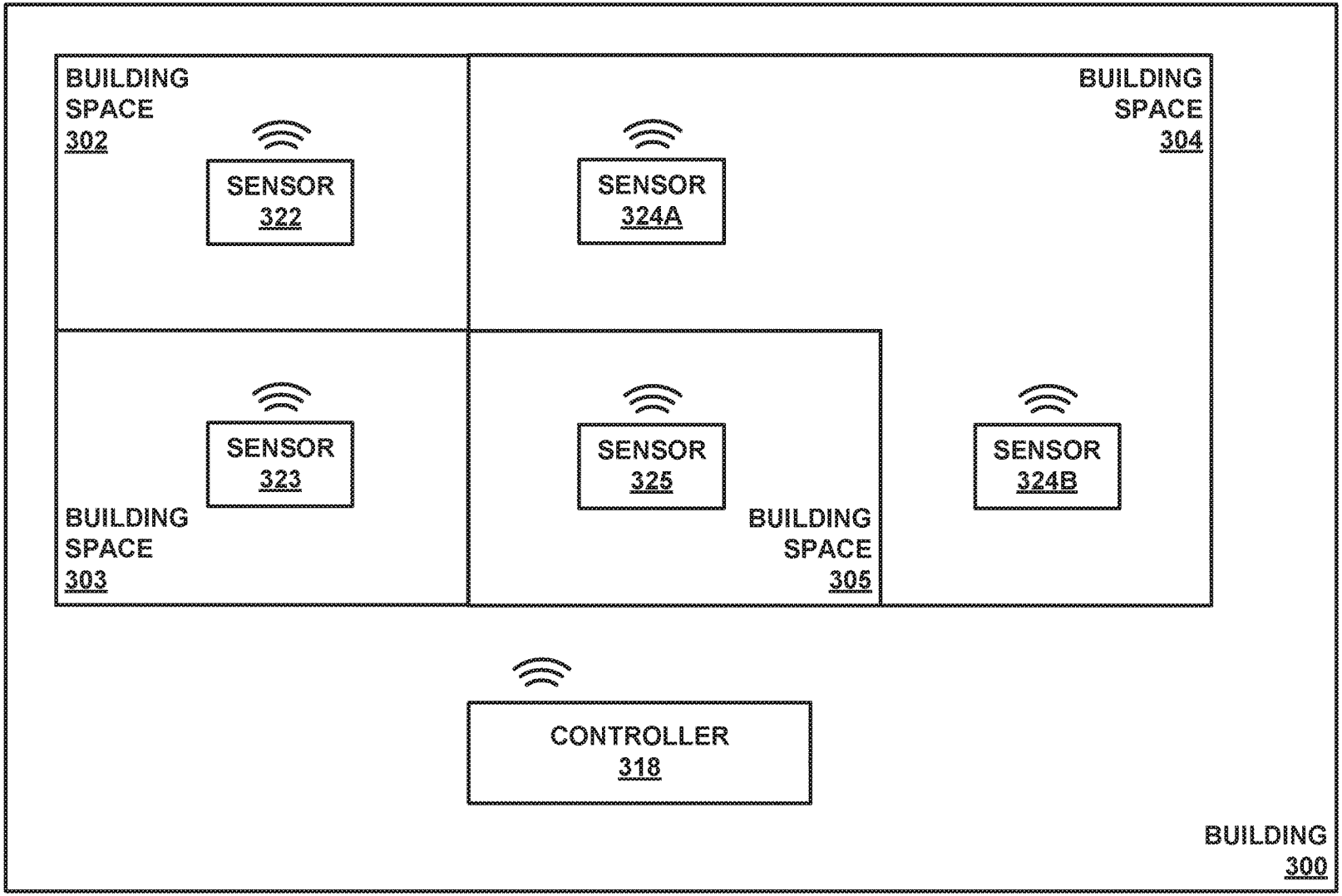
FIG. 3 is conceptual block diagram of an HVAC system with sensors in a plurality of spaces in a building, in accordance with some examples of this disclosure.

FIG. 3 is conceptual block diagram of an HVAC system with sensors in a plurality of spaces 302-305 in a building 300, in accordance with some examples of this disclosure. Building 300 is divided into distinct building spaces labeled 302-305. Each of building spaces 302-305 may be separate rooms, for example. Building spaces 302-305 may instead refer to sections or portions of building 300. For example, if building 300 has an open floor plan, there may not be walls dividing out and defining each of building spaces 302-305. Some of building spaces 302-305 may have sizes or shapes that are different from others of building spaces 302-305. These relative sizes and shapes are merely illustrative, and are intended to indicate that building 300 is divided into a number of spaces, regardless of whether the spaces are defined by physical walls or are portions of an open space.

Sensors 322-325 are mounted in building spaces 302-305, where each of sensors 322-325 is an example of remote sensors 121A, 121B, and 121T shown in FIG. 1. Each of sensors 322-325 may include a temperature sensor, a humidity sensor, an occupancy sensor, an air quality sensor (e.g., carbon dioxide sensor, pollen sensor, etc.), a light sensor, and/or any other suitable sensor. Examples of occupancy sensors include passive infrared (PIR) sensors, microwave sensors, audio sensors, and so on. The building space 302 is shown as including sensor 322, building space 303 includes sensor 323, building space 304 includes sensors 324A and 324B, and the building space 305 includes sensor 325. Each of sensors 322-325 communicates with controller 318, either wirelessly or through a hardwired connection.

Controller 318 can determine whether building spaces 302-305 are occupied based on signals received by controller 318 from sensors 322-325 in examples in which sensors 322-325 are able to sense motion or occupancy. In examples in which controller 318 determines that building space 302 is occupied and that building spaces 303-305 are not occupied, controller 318 may be configured to turn on or off an HVAC component (e.g., a furnace, AC, and/or blower) based on the temperature detected by sensor 322. In examples in which controller 318 determines that all of building spaces 302-305 are occupied, controller 318 may be configured to turn on or off an HVAC component based on an average of the temperatures detected by sensors 322-325.

In some examples, building 300 may include sensors 322-324B before the installation of sensor 325. Controller 318 may be configured to determine that a new temperature sensor (e.g., sensor 325) has been added to building 300 based on user input or based on communicating with sensor 325 through a wired or wireless connection. In response to determining that a new temperature sensor has been added to building 300, controller 318 may be configured to prompt a user about whether the new temperature sensor should be treated as the fallback temperature sensor. For example, controller 318 may present a user interface to a user stating that controller 318 has detected a new temperature sensor and asking the user whether to set the new temperature sensor as the fallback temperature sensor. As another example, controller 318 can cause a remote device, such as a mobile phone, to prompt the user whether to set the new temperature sensor as the fallback temperature sensor. Controller 318 and/or the remote device can present an indication of the new temperature sensor to the user as a possible fallback temperature sensor and prompt the user to select the new temperature sensor.

Although the techniques of this disclosure are described with respect to temperature control, the same techniques can also apply to the control of the humidity within building 300. For example, when all of building spaces 302-305 are occupied, controller 318 may be configured to control an HVAC component based on an average of the humidity measurements taken by sensors 322-325. In examples in which controller 318 determines that building 300 includes two occupied spaces (e.g., building spaces 302 and 303), controller 318 can control the HVAC component based on an average of the temperatures sensed by sensors 322 and 323. In examples in which controller 318 determines that building spaces 302-305 are unoccupied, controller 318 may be configured to control the HVAC component based on the humidity measurement at the fallback temperature sensor.

In some examples, controller 318 may receive user input indicating more than one temperature sensor as the fallback temperature sensors. For example, a user may select sensors 323 and 325 as fallback temperature sensors by providing user input to controller 318. In examples in which sensors 323 and 325 are selected as fallback temperature sensors, and when controller 318 determines that building spaces 302-305 are unoccupied, controller 318 may be configured to control the HVAC component based on an average value of the temperatures sensed by sensors 323 and 325.

Figure 4:
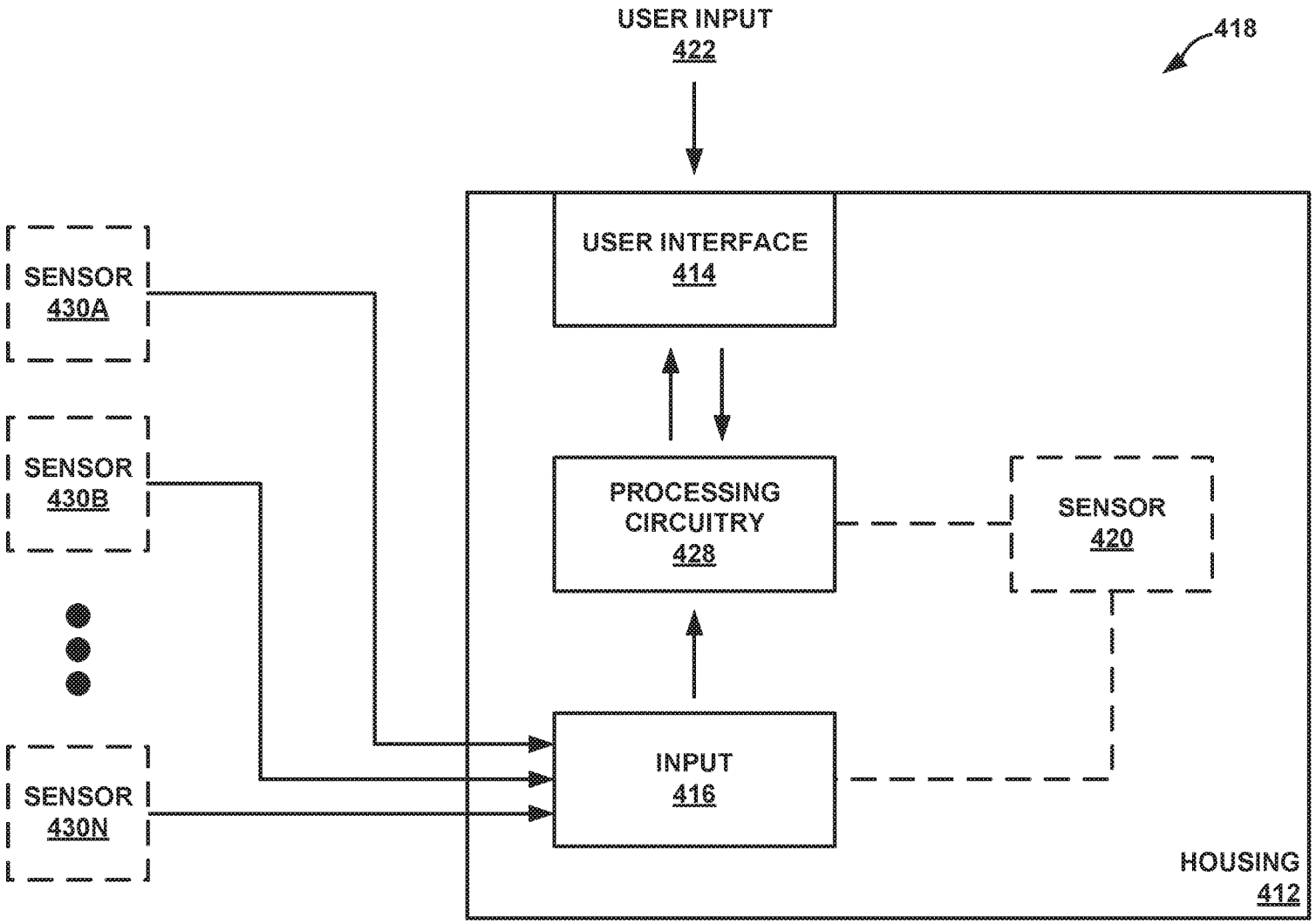
FIG. 4 is a conceptual block diagram of a controller for an HVAC system, in accordance with some examples of this disclosure.

FIG. 4 is a conceptual block diagram of a controller 418 for an HVAC system, in accordance with some examples of this disclosure. In some examples, controller 418 may be a wall-mountable thermostat. Controller 418 may be configured to receive signals from a plurality of sensors, such as sensors 420 and 430A-430N, that are positioned in different spaces within a building. Controller 418 includes housing 412 and user interface 414 that is accessible from an exterior of housing 412. Controller 418 includes input 416 for receiving signals from sensors 420 and 430A-430N. In some examples, input 416 may be a wireless receiver or wireless transceiver. Sensor 420 is located within housing 412 of controller 418, as indicated by sensor 420 shown in FIG. 4, and sensors 430A-430N are remote sensors that are located outside of controller 418, such as in different building spaces.

In some cases, input 416 receives current temperatures reported from each of the sensors, with each current temperature corresponding to a particular space in which each sensor is located. In some examples, not all of sensors 430A-430N are configured to sense temperature. Some of sensors 430A-430N may be configured to sense only occupancy (e.g., motion, heat, or light). Each communication from one of sensors 430A-430N to controller 418 may include an address of the sending sensor, so that controller 418 can determine which sensor sent the reported temperature. Processing circuitry 428 of controller 418 is operably coupled to user interface 414 and to input 416. In some cases, processing circuitry 428 is configured to control the HVAC system using a control temperature that is a weighted combination of two or more of the current temperatures being reported by the sensors by which occupancy has been detected. In some instances, the weighted combination is a weighted average of two or more of the current temperatures being reported by the plurality of sensors. Controller 418 may repeatedly receive, via input 416, updated current temperatures from each of the plurality of sensors, and controller 418 may be configured to utilize the updated current temperatures to produce an updated control temperature.

Controller 418 may track which of the different spaces are currently occupied and how long each of the currently occupied spaces have been occupied. As a currently occupied space remains occupied for a longer period of time, controller 418 provides increasing weight over time to the current temperature reported by the sensor that is in that currently occupied space. Controller 418 may be configured to control the HVAC system in order to drive the control temperature towards a temperature set point.

In some cases, each space within a building may have separate temperature sensors and occupancy sensors. In other cases, at least some of the plurality of sensors may not only report the current temperature but may also include an occupancy sensor to report an indication of occupancy to controller 418. In some particular instances, each of the plurality of sensors may include an occupancy sensor (e.g., a light, heat, or motion sensor), and thus each of the plurality of sensors may report an occupancy status in combination with a current temperature. As an example, sensor 430A may provide an indication that a building space is currently occupied. In some cases, controller 418 may be configured to more heavily weight the current temperature reported by those of the plurality of sensors that are in currently occupied spaces relative to the current temperature reported by those of the plurality of sensors that are in currently unoccupied spaces.

In some examples, sensors 430A-430N include temperature and/or humidity sensors that are not capable of sensing motion or occupancy. Processing circuitry 428 can determine occupancy in a building based on whether any mobile phones are connected to a wireless network or based on an alarm status. Processing circuitry 428 can also determine occupancy based on time of day and day of the week. In addition, processing circuitry 428 can determine occupancy based on user input 422 in examples in which user input 422 indicates that the building is unoccupied (e.g., the user selects an option for occupancy or no occupancy).

In some cases, at least some of the plurality of sensors may include a priority ranking, and controller 418 may be configured to weight the current temperatures reported by sensors of the plurality of sensors that are in currently occupied spaces in accordance with the priority ranking of those sensors. In some instances, controller 418 may be configured to assign higher weights to the current temperatures reported by the sensors that have a higher priority ranking and to assign lower weights to the current temperatures reported by the sensors that have a lower priority ranking.

In some instances, controller 418 may be operably coupled to user interface 414, optional sensor 420, and input 416. Sensor 420 may be a temperature sensor and/or an occupancy sensor. Controller 418 may be configured to control the HVAC system in accordance with a temperature set point and a control temperature in order to drive the control temperature towards the temperature set point. The control temperature may be equal to the current temperature that is sensed by the fallback sensor when processing circuitry 428 detects no occupancy in the building. When controller 418 determines that the building is occupied, the control temperature may be equal to a blended value of the current temperature sensed by sensor 420 and the current temperature provided by at least one of sensors 430A-430N where occupancy is indicated in the space in which the particular sensor is located, and wherein the blended value is increasingly influenced by the current temperature provided by the at least one of the remote sensors with continued occupancy of the corresponding space. Example details of determining blended values from multiple sensors can be found in commonly assigned U.S. patent application Ser. No. 16/156,954, filed on Oct. 10, 2018, entitled "Remote Sensor with Improved Occupancy Sensing," the entire contents of which are incorporated herein.

In examples in which controller 418 prompts a user to select a fallback temperature sensor, controller 418 may be configured to present an indication of a recommended fallback temperature sensor to the user via user interface 414. For example, processing circuitry 428 can cause user interface 414 to present text asking the user whether the user would like to select sensor 420 as the fallback temperature sensor, such as: "would you like to use the temperature in this room for controlling the furnace and AC when no one is home?" The recommended fallback temperature sensor may be any of sensors 420 and 430A-430N. User interface 414 may allow the user to click or touch the indication of the recommended fallback temperature sensor to select the recommended fallback temperature sensor.

In response to determining that controller 418 has not received user input after presenting the recommended fallback temperature sensor, processing circuitry 428 can select the recommended fallback temperature sensor as the actual fallback temperature sensor by default. Thus, if the user does not respond to prompting by controller 418 about the recommended fallback temperature sensor, processing circuitry 428 can automatically use the recommended fallback temperature sensor until the user selects a different fallback temperature sensor. Processing circuitry 428 may allow a user to change the fallback temperature sensor at any time using a menu presented on user interface 414. Additionally or alternatively, in response to determining that controller 418 has not received user input after presenting the recommended fallback temperature sensor, processing circuitry 428 may be configured to present indications of other temperature sensors and prompt the user to select the fallback temperature sensor from the other sensors. Thus, if the user does not choose sensor 420 as the fallback temperature sensor, processing circuitry 428 can follow up by asking the user about sensors 430A, 430B, and/or 430N.

Figure 5:
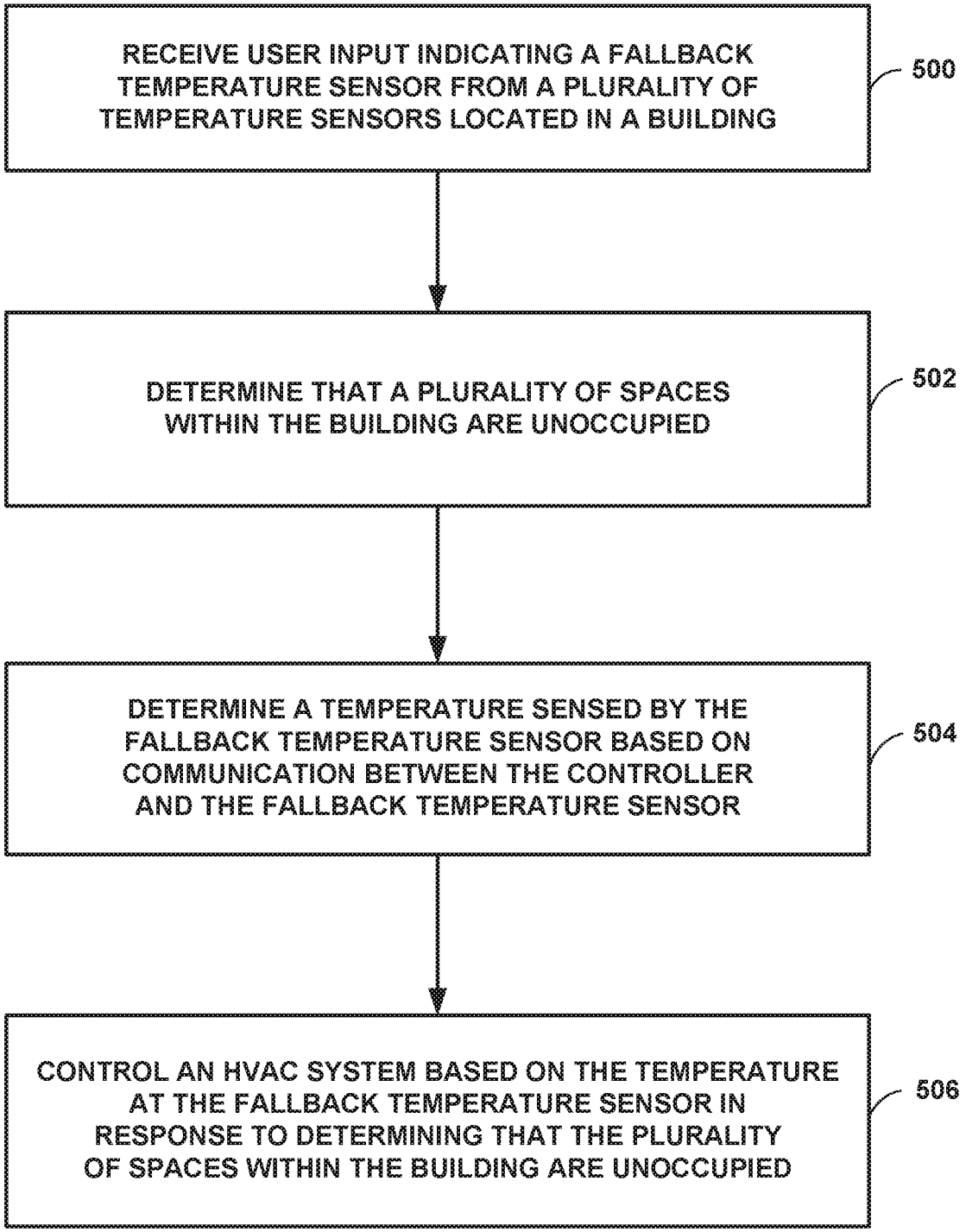
FIG. 5 is a flowchart illustrating an example process for controlling an HVAC system based on the temperature sensed by a fallback temperature sensor, in accordance with some examples of this disclosure.

FIG. 5 is a flowchart illustrating an example process for controlling an HVAC system based on the temperature sensed by a fallback temperature sensor, in accordance with some examples of this disclosure. The example process of FIG. 5 is described with reference to controller 318 shown in FIG. 3, although other components such as controllers 118,218, and 418 shown in FIGS. 1,2, and 4 may exemplify similar techniques.

In the example of FIG. 5, controller 318 receives user input indicating a fallback temperature sensor from sensors 322-325 in building 300 (500). Controller 318 can present a list of sensors 322-325 to a user and prompt the user to select one of sensors 322-325 by pressing a button, touching a screen, or providing a voice command. Additionally or alternatively, controller 318 can present an indication of sensor 322 and prompt the user to select sensor 322 as the fallback temperature sensor.

In the example of FIG. 5, controller 318 determines that building spaces 302-305 within building 300 are unoccupied (502). Controller 318 can determine occupancy using various sources of information, including communication between controller 318 and sensors 322-325. Controller 318 can receive signals from each of sensors 322-325 indicating whether sensors 322-325 have detected motion or occupancy. Controller 318 may be configured to set a timer in response to determining that building spaces 302-305 are unoccupied and begin operating in no-occupancy mode only after the timer reaches a threshold duration of time.

In the example of FIG. 5, controller 318 determines a temperature at the fallback temperature sensor based on communication between controller 318 and the fallback temperature sensor (504). In examples in which sensor 322 is the fallback temperature sensor, controller 318 can receive signals from sensor 322 indicating the temperature sensed by sensor 322. In some examples, sensor 322 includes processing circuitry configured to determine the temperature. Sensor may then send a signal indicating the temperature to controller 318. Controller 318 receives the signal from sensor 322 and determines the temperature sensed by sensor 322 based on the signal.

In the example of FIG. 5, controller 318 causes an HVAC system to turn on or off based on the temperature at the fallback temperature sensor in response to determining that building spaces 302-305 are unoccupied (506). In examples in which the temperature sensed by the fallback temperature sensor is less than a lower threshold, controller 318 can cause a furnace to turn on and generate heat. In examples in which the temperature sensed by the fallback temperature sensor is greater than a higher threshold, controller 318 can cause an AC to turn on and provide cooling.

Figure 6:
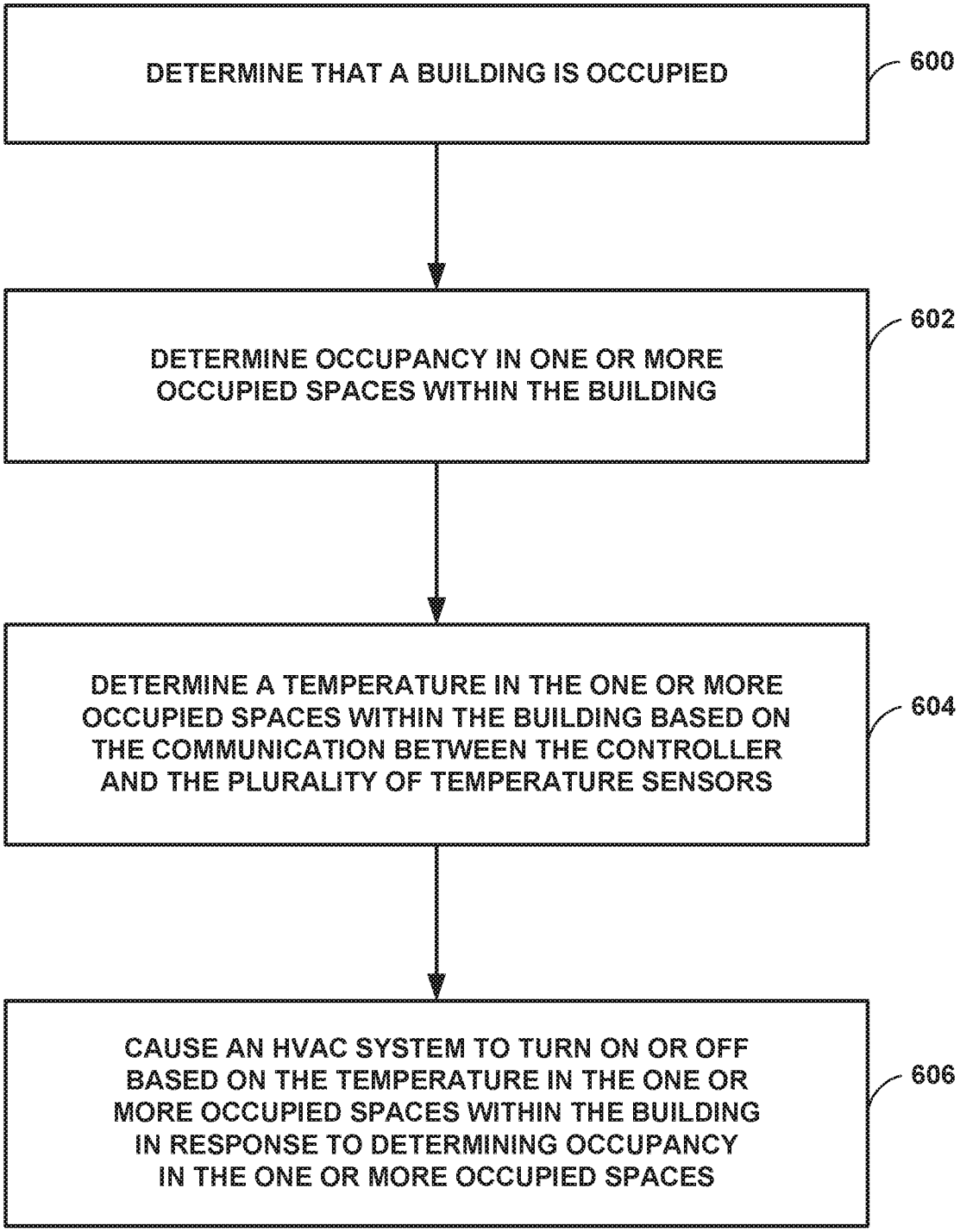
FIG. 6 is a flowchart illustrating an example process for controlling an HVAC system based on the sensed temperatures in occupied spaces, in accordance with some examples of this disclosure.

FIG. 6 is a flowchart illustrating an example process for controlling an HVAC system based on the sensed temperatures in occupied spaces, in accordance with some examples of this disclosure. The example process of FIG. 6 is described with reference to controller 318 shown in FIG. 3, although other components such as controllers 118,218, and 418 shown in FIGS. 1,2, and 4 may exemplify similar techniques.

In the example of FIG. 6, controller 318 determines whether building 300 is occupied 300 (600). Example techniques for determining building-level occupancy include occupancy sensors, geo-fencing, devices connected to wireless networks, alarm status, preprogrammed days and times, and/or other techniques described herein.

In response to determining that building 300 is occupied, controller 318 determines occupancy in one or more spaces within building 300 (602). For example, controller 318 can determine that space 304 is occupied based on communication between controller 318 and sensor 324A or 324B. Sensor 324A may be configured to detect occupancy based on sensing motion, heat signatures (infrared sensing), and/or light. Additionally or alternatively, controller 318 can assume occupancy in space 304 during particular days and times.

Controller 318 then determines a temperature in the one or more occupied spaces within building 300 based on the communication between controller 318 and sensors 322-325 (604). For example, in response to determining that space 304 is occupied, controller 318 can determine the temperature sensed by sensors 324A and 324B. Controller 318 causes an HVAC system to turn on or off based on temperature in the one or more occupied spaces within building 300 in response to determining occupancy in the one or more occupied spaces (606). In examples in which controller 318 determines occupancy in space 304, controller 318 can control the HVAC system based on an average of the temperatures sensed by sensors 324A and 324B. If controller 318 also determines occupancy in space 302, controller 318 can control the HVAC system based on an average of the temperatures sensed by sensors 322, 324A, and 324B.

Figure 7:
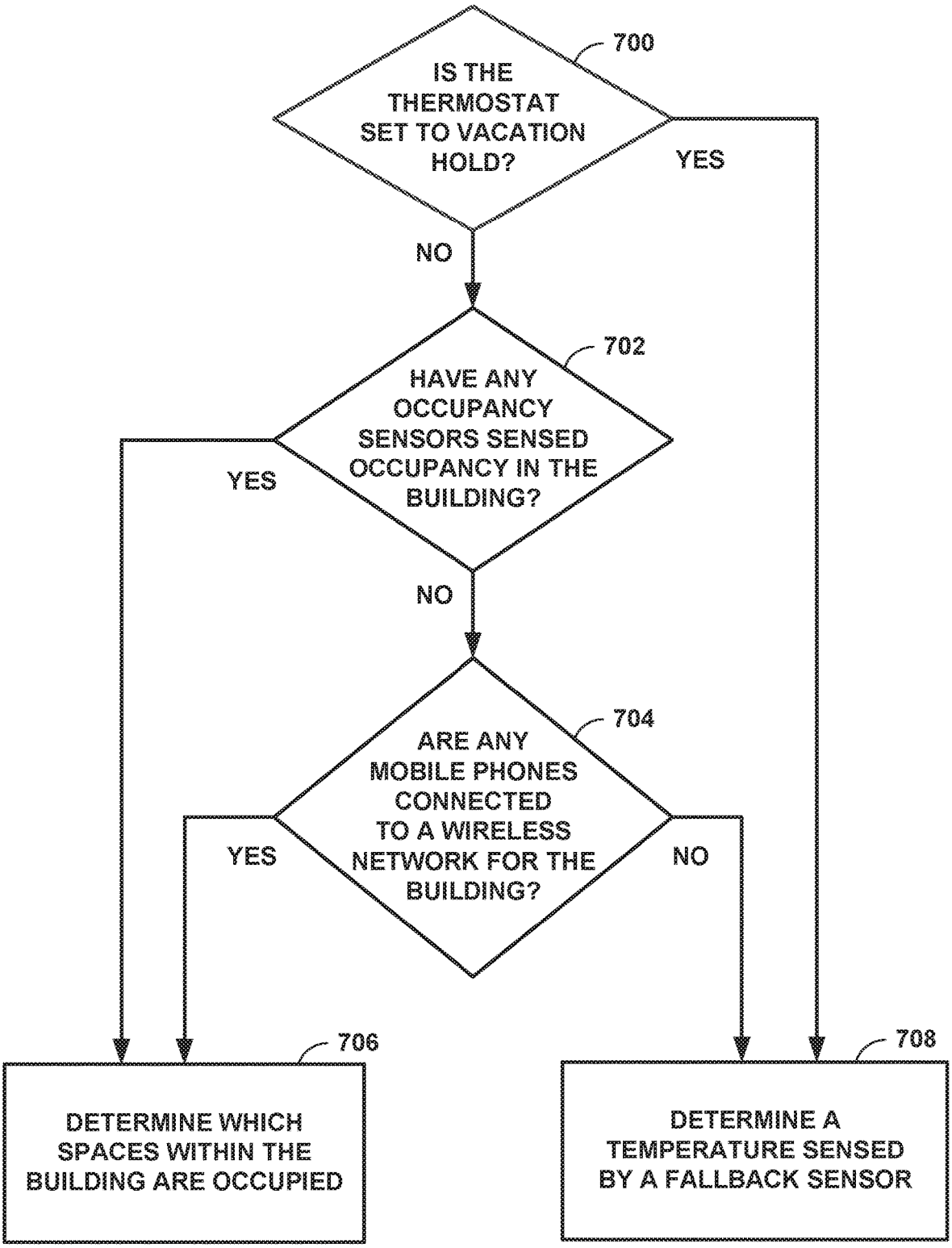
FIG. 7 is a flowchart illustrating an example process for determining building-level occupancy, in accordance with some examples of this disclosure.

FIG. 7 is a flowchart illustrating an example process for determining building-level occupancy, in accordance with some examples of this disclosure. The example process of FIG. 7 is described with reference to controller 318 shown in FIG. 3, although other components such as controllers 118, 218, and 418 shown in FIGS. 1, 2, and 4 may exemplify similar techniques. Decision blocks 700, 702, and 704 are example techniques for determining building-level occupancy. Other techniques for determining building-level occupancy are described herein. Controller 318 can use any combination of techniques for determining building-level occupancy.

In the example of FIG. 7, controller 318 determines whether a thermostat in building 300 is set to a vacation hold (700). A user can set the thermostat to a vacation hold so that controller 318 assumes no occupancy during the period of the vacation hold. In response to determining that a vacation hold has not been set, controller 318 determines whether any of sensors 322-325 have sensed occupancy in building 300 (702). In examples in which sensors 322-325 include occupancy sensors, sensors 322-325 may be configured to sense motion, light, and/or heat. Each occupancy sensor may be configured to time out after not having sensed occupancy for a predetermined time period. For example, an occupancy sensor can time out after not having sensed motion for three, five, or ten minutes.

In response to determining that no occupancy sensors have sensed occupancy, controller 318 determines whether any mobile phones are connected to a wireless network for building 300 (704). Controller 318 may be connected to the wireless network and may be able to communicate with a wireless router. Controller 318 can determine whether any mobile phones are connected to the wireless network based on communication with the router.

There may be additional techniques for determining building-level occupancy, other than the techniques shown in decision blocks 700, 702, and 704. For example, controller 318 can use the alarm status (away with alarm, stay with alarm, or disarm) to determine building-level occupancy. Controller 318 can also use the preprogrammed times and days for determining occupancy. For example, controller 318 can assume no occupancy between 10:00 a.m. and 4:00 p.m. on weekdays and can assume occupancy between 10:00 p.m. and 6:00 a.m. every day.

In response to determining building-level occupancy at decision block 702 and/or 704, controller 318 can determine which of spaces 302-305 are occupied (706). The determination of which of spaces 302-305 are occupied is referred to as determining room-level occupancy. In response to determining no building-level occupancy at decision block 702 and/or 706, controller 318 can determine a temperature sensed by a fallback sensor (708).

The following numbered examples demonstrate one or more aspects of the disclosure.

Example 1

A method for controlling an HVAC system for a building, the method including receiving, at a controller of the HVAC system, user input indicating a fallback temperature sensor from a plurality of temperature sensors in the building. The plurality of temperature sensors in the building are associated with a plurality of spaces within the building. The method also includes determining, by the controller, that the plurality of spaces within the building are unoccupied. The method further includes determining, by the controller, a temperature sensed by the fallback temperature sensor based on communication between the controller and the fallback temperature sensor. The method includes causing, by the controller, the HVAC system to turn on or off based on the temperature at the fallback temperature sensor in response to determining that the plurality of spaces within the building are unoccupied.

Example 2

The method of example 1, further including, at a time after determining that the plurality of spaces within the building are unoccupied, determining, by the controller, that at least one space of the plurality of spaces within the building is occupied.

Example 3

The method of examples 1-2 or any combination thereof, further including determining a temperature at a first temperature sensor of the plurality of temperature sensors based on communication between the controller and the first temperature sensor.

Example 4

The method of examples 1-3 or any combination thereof, further including causing the HVAC system to turn on or off based on the temperature at the first temperature sensor in response to determining that the at least one space within the building is occupied.

Example 5

The method of examples 1-4 or any combination thereof, further including prompting a user to select the fallback temperature sensor from the plurality of temperature sensors and receiving the user input after prompting the user to select the fallback temperature sensor.

Example 6

The method of examples 1-5 or any combination thereof, where the fallback temperature sensor is a selected fallback temperature sensor, and prompting the user comprises presenting an indication of a recommended fallback temperature sensor to the user.

Example 7

The method of examples 1-6 or any combination thereof, further including determining that the controller has not received the user input.

Example 8

The method of examples 1-7 or any combination thereof, further including selecting the recommended fallback temperature sensor as the selected fallback temperature sensor in response to determining that the controller has not received the user input.

Example 9

The method of examples 1-8 or any combination thereof, where a thermostat of the HVAC system comprises the controller and an integrated temperature sensor.

Example 10

The method of examples 1-9 or any combination thereof, where presenting the indication of the recommended fallback temperature sensor comprises presenting an indication of the integrated temperature sensor to the user as the recommended fallback temperature sensor.

Example 11

The method of examples 1-10 or any combination thereof, further including receiving the user input indicating that the user has not selected the recommended fallback temperature sensor as the selected fallback temperature sensor.

Example 12

The method of examples 1-11 or any combination thereof, where presenting indications of other temperature sensors of the plurality of temperature sensors in response to determining that the user has not selected the recommended fallback temperature sensor as the selected fallback temperature sensor and prompting the user to select the fallback temperature sensor from the other temperature sensors.

Example 13

The method of examples 1-12 or any combination thereof, further including determining that a new temperature sensor has been added to the plurality of temperature sensors.

Example 14

The method of examples 1-13 or any combination thereof, further including prompting a user whether the new temperature sensor should be the fallback temperature sensor in response to determining that the new temperature sensor has been added to the plurality of temperature sensors.

Example 15

The method of examples 1-14 or any combination thereof, where each temperature sensor of the plurality of temperature sensors comprises a combined temperature and occupancy sensor, and determining that the plurality of spaces within the building are unoccupied comprises determining no occupancy in the plurality of spaces is based on communication between the controller and the plurality of temperature sensors.

Example 16

The method of examples 1-15 or any combination thereof, where receiving the user input indicating the fallback temperature sensor comprises receiving the user input indicating two or more fallback temperature sensors from the plurality of temperature sensors, and determining the temperature at the fallback temperature sensor comprises determining temperatures at the two or more fallback temperature sensors based on communication between the controller and the two or more fallback temperature sensors.

Example 17

The method of examples 1-16 or any combination thereof, where controlling the HVAC system comprises controlling the HVAC system based on an average value of the temperatures at the two or more fallback temperature sensors in response to detecting no occupancy in the plurality of spaces.

Example 18

The method of examples 1-17 or any combination thereof, further including detecting occupancy in one or more occupied spaces of the plurality of spaces based on communication between the controller and the plurality of temperature sensors. The method also includes determining a temperature in the one or more occupied spaces at the fallback temperature sensor based on communication between the controller and the fallback temperature sensor, and controlling the HVAC system based on the temperature in the one or more occupied spaces in response to detecting occupancy in the one or more occupied spaces.

Example 19

A controller for an HVAC system in a building, the controller including a user interface configured to receive user input indicating a fallback temperature sensor from the plurality of temperature sensors in the building. The controller also includes processing circuitry configured to determine that the plurality of spaces within the building are occupied. The processing circuitry is also configured to determine a temperature sensed by the fallback temperature sensor based on communication between the controller and the fallback temperature sensor. The processing circuitry is further configured to cause the HVAC system to turn on or off based on the temperature at the fallback temperature sensor in response to determining that the plurality of spaces within the building are unoccupied.

Example 20

The controller of example 19, where the processing circuitry is configured to perform the method of examples 1-18 or any combination thereof.

Example 21

The controller of examples 19 or 20, where the user interface is configured to prompt the user by presenting a recommended fallback sensor to the user.

Example 22

The controller of examples 19-21 or any combination thereof, where the processing circuitry is configured to determine that the user interface has not received the user input and select the recommended fallback sensor as the selected fallback sensor in response to determining that the user interface has not received the user input.

Example 23

The controller of examples 19-22 or any combination thereof, where the user interface is configured to present the recommended fallback sensor by presenting the integrated sensor to the user as the recommended fallback sensor.

Example 24

The controller of examples 19-23 or any combination thereof, where the user interface is configured to cause the user interface to present indications of other sensors of the plurality of sensors in response to determining that the user has not selected the recommended fallback sensor as the selected fallback sensor. The user interface is also configured to cause the user interface to prompt the user to select the fallback sensor from the other sensors.

Example 25

The controller of examples 19-24 or any combination thereof, where the processing circuitry is configured to determine that the user interface has not received the user input and select the recommended fallback sensor as the selected fallback sensor in response to determining that the user interface has not received the user input.

Example 26

The controller of examples 19-25 or any combination thereof, where the processing circuitry is configured to determine that a new sensor has been added to the plurality of sensors.

Example 27

The controller of examples 19-26 or any combination thereof, where the processing circuitry is configured to cause the user interface is configured to prompt a user whether the new sensor should be the fallback sensor in response to determining that the new sensor has been added to the plurality of sensors.

Example 28

The controller of examples 19-27 or any combination thereof, where the processing circuitry is configured to determine the temperature at the fallback sensor by determining temperatures at the two or more fallback sensors based on communication between the controller and the two or more fallback sensors.

Example 29

The controller of examples 19-28 or any combination thereof, where the processing circuitry is configured to control the HVAC system by controlling the HVAC system based on an average value of the temperatures at the two or more fallback sensors in response to detecting no occupancy in the plurality of spaces.

Example 30

The controller of examples 19-29 or any combination thereof, where the processing circuitry is configured to detect occupancy in one or more occupied spaces of the plurality of spaces based on communication between the controller and the plurality of sensors.

Example 31

The controller of examples 19-30 or any combination thereof, where the processing circuitry is configured to determine a temperature in the one or more occupied spaces at the fallback sensor based on communication between the controller and the fallback sensor.

Example 32

The controller of examples 19-31 or any combination thereof, where the processing circuitry is configured to control the HVAC system based on the temperature in the one or more occupied spaces in response to detecting occupancy in the one or more occupied spaces.

Example 33

A device includes a computer-readable medium having executable instructions stored thereon, configured to be executable by processing circuitry for causing the processing circuitry to receive user input indicating a fallback temperature sensor from a plurality of temperature sensors in a building, where the plurality of temperature sensors in the building are associated with a plurality of spaces within the building. The instructions are further configured to cause the processing circuitry to determine that the plurality of spaces within the building are unoccupied and to determine a temperature sensed by the fallback temperature sensor based on communication between the device and the fallback temperature sensor. The instructions are also configured to cause the processing circuitry to control a heating, ventilation, and air conditioning system for the building based on the temperature at the fallback temperature sensor in response to determining that the plurality of spaces within the building are unoccupied.

Example 34

The device of example 33, where the instructions are configured to cause the processing circuitry to perform the method of examples 1-18 or any combination thereof.

Example 35

The device of example 33 or example 34 or any combination thereof, where the computer-readable medium includes a non-transitory computer-readable medium.

The disclosure contemplates computer-readable storage media comprising instructions to cause a processor to perform any of the functions and techniques described herein. The computer-readable storage media may take the example form of any volatile, non-volatile, magnetic, optical, or electrical media, such as a RAM, ROM, NVRAM, EEPROM, or flash memory. The computer-readable storage media may be referred to as non-transitory. A computing device may also contain a more portable removable memory type to enable easy data transfer or offline data analysis.

The techniques described in this disclosure, including those attributed to controllers 118, 218, 318, and 418, processing circuitry 428, user interface 414, sensors 121A, 121B, 121T, 322, 324, 326A, 326B, 328, 420, and 430A-430N, and various constituent components, may be implemented, at least in part, in hardware, software, firmware or any combination thereof. For example, various aspects of the techniques may be implemented within one or more processors, including one or more microprocessors, DSPs, ASICs, FPGAs, or any other equivalent integrated or discrete logic circuitry, as well as any combinations of such components. The term "processor" or "processing circuitry"

may generally refer to any of the foregoing logic circuitry, alone or in combination with other logic circuitry, or any other equivalent circuitry.

As used herein, the term "circuitry" refers to an ASIC, an electronic circuit, a processor (shared, dedicated, or group) and memory that execute one or more software or firmware programs, a combinational logic circuit, or other suitable components that provide the described functionality. The term "processing circuitry" refers one or more processors distributed across one or more devices. For example, "processing circuitry" can include a single processor or multiple processors on a device. "Processing circuitry" can also include processors on multiple devices, wherein the operations described herein may be distributed across the processors and devices.

Such hardware, software, firmware may be implemented within the same device or within separate devices to support the various operations and functions described in this disclosure. For example, any of the techniques or processes described herein may be performed within one device or at least partially distributed amongst two or more devices, such as between controllers 118, 218, 318, and 418, processing circuitry 428, user interface 414, and/or sensors 121A, 121B, 121T, 322, 324, 326A, 326B, 328, 420, and 430A-430N. In addition, any of the described units, modules or components may be implemented together or separately as discrete but interoperable logic devices. Depiction of different features as modules or units is intended to highlight different functional aspects and does not necessarily imply that such modules or units must be realized by separate hardware or software components. Rather, functionality associated with one or more modules or units may be performed by separate hardware or software components, or integrated within common or separate hardware or software components.

The techniques described in this disclosure may also be embodied or encoded in an article of manufacture including a non-transitory computer-readable storage medium encoded with instructions. Instructions embedded or encoded in an article of manufacture including a non-transitory computer-readable storage medium encoded, may cause one or more programmable processors, or other processors, to implement one or more of the techniques described herein, such as when instructions included or encoded in the non-transitory computer-readable storage medium are executed by the one or more processors. Example non-transitory computer-readable storage media may include RAM, ROM, programmable ROM (PROM), EPROM, EEPROM, flash memory, a hard disk, a compact disc ROM (CD-ROM), a floppy disk, a cassette, magnetic media, optical media, or any other computer readable storage devices or tangible computer readable media.

In some examples, a computer-readable storage medium comprises non-transitory medium. The term "non-transitory" may indicate that the storage medium is not embodied in a carrier wave or a propagated signal. In certain examples, a non-transitory storage medium may store data that can, over time, change (e.g., in RAM or cache). Elements of devices and circuitry described herein, including, but not limited to, controllers 118, 218, 318, and 418, processing circuitry 428, user interface 414, and/or sensors 121A, 121B, 121T, 322, 324, 326A, 326B, 328, 420, and 430A-430N, may be programmed with various forms of software. The one or more processors may be implemented at least in part as, or include, one or more executable applications, application modules, libraries, classes, methods, objects, routines, subroutines, firmware, and/or embedded code, for example.

Various examples of the disclosure have been described. Any combination of the described systems, operations, or functions is contemplated. These and other examples are within the scope of the following claims.

What is claimed is:

1. A method for controlling a heating, ventilation, and air conditioning (HVAC) system for a building, the method comprising:

prompting, at a controller of the HVAC system, a user to select a temperature sensor from a plurality of temperature sensors in the building to be a fallback temperature sensor, wherein the plurality of temperature sensors in the building are associated with a plurality of spaces within the building;

receiving, at the controller, user input indicating the fallback temperature sensor after prompting the user;

determining, by the controller, that the plurality of spaces within the building are unoccupied;

determining, by the controller, a temperature sensed by the fallback temperature sensor based on communication between the controller and the fallback temperature sensor;

causing, by the controller, the HVAC system to turn on or off based on the temperature at the fallback temperature sensor in response to determining that the plurality of spaces within the building are unoccupied;

at a time after determining that the plurality of spaces within the building are unoccupied, determining, by the controller, that at least one space of the plurality of spaces within the building is occupied;

determining a temperature at a first temperature sensor of the plurality of temperature sensors based on communication between the controller and the first temperature sensor, wherein the first temperature sensor is associated with the at least one space; and causing the HVAC system to turn on or off based on the temperature at the first temperature sensor in response to determining that the at least one space within the building is occupied.

2. The method of claim 1, wherein the fallback temperature sensor is a selected fallback temperature sensor, and wherein prompting the user comprises presenting an indication of a recommended fallback temperature sensor to the user.

3. The method of claim 2, further comprising:

determining that the controller has not received the user input; and selecting the recommended fallback temperature sensor as the selected fallback temperature sensor in response to determining that the controller has not received the user input.

4. The method of claim 2, wherein a thermostat of the HVAC system comprises the controller and an integrated temperature sensor, and wherein presenting the indication of the recommended fallback temperature sensor comprises presenting an indication of the integrated temperature sensor to the user as the recommended fallback temperature sensor.

5. The method of claim 2, further comprising receiving the user input indicating that the user has not selected the recommended fallback temperature sensor as the selected fallback temperature sensor, wherein prompting the user further comprises:

presenting indications of other temperature sensors of the plurality of temperature sensors in response to determining that the user has not selected the recommended fallback temperature sensor as the selected fallback temperature sensor; and prompting the user to select the fallback temperature sensor from the other temperature sensors.

6. The method of claim 1, further comprising:

determining that a new temperature sensor has been added to the plurality of temperature sensors;

prompting the user whether the new temperature sensor should be the fallback temperature sensor in response to determining that the new temperature sensor has been added to the plurality of temperature sensors.

7. The method of claim 1, wherein each temperature sensor of the plurality of temperature sensors comprises a combined temperature and occupancy sensor, wherein determining that the plurality of spaces within the building are unoccupied comprises determining no occupancy in the plurality of spaces is based on communication between the controller and the plurality of temperature sensors.

8. The method of claim 1, wherein receiving the user input indicating the fallback temperature sensor comprises receiving the user input indicating two or more fallback temperature sensors from the plurality of temperature sensors, wherein determining the temperature at the fallback temperature sensor comprises determining temperatures at the two or more fallback temperature sensors based on communication between the controller and the two or more fallback temperature sensors, and wherein controlling the HVAC system comprises controlling the HVAC system based on an average value of the temperatures at the two or more fallback temperature sensors in response to detecting no occupancy in the plurality of spaces.

9. The method of claim 1, wherein the fallback temperature sensor is different from the first temperature sensor.

10. A controller for a heating, ventilation, and air conditioning (HVAC) system in a building, the controller comprising:

a user interface configured to:

prompt a user to select a temperature sensor from a plurality of temperature sensors in the building to be a fallback temperature sensor, wherein the plurality of temperature sensors in the building are associated with a plurality of spaces within the building; and receive user input indicating the fallback temperature sensor after prompting the user; and processing circuitry configured to:

determine that the plurality of spaces within the building are unoccupied;

determine a temperature sensed by the fallback temperature sensor based on communication between the controller and the fallback temperature sensor;

cause the HVAC system to turn on or off based on the temperature at the fallback temperature sensor in response to determining that the plurality of spaces within the building are unoccupied;

at a time after determining that the plurality of spaces within the building are unoccupied, determine that at least one space of the plurality of spaces within the building is occupied;

determine a temperature at a first temperature sensor of the plurality of temperature sensors based on communication between the controller and the first temperature sensor, wherein the first temperature sensor is associated with the at least one space; and cause the HVAC system to turn on or off based on the temperature at the first temperature sensor in response to determining that the at least one space within the building is occupied.

11. The controller of claim 10, wherein the fallback temperature sensor is a selected fallback temperature sensor, and wherein the user interface is configured to prompt the user by presenting a recommended fallback temperature sensor to the user.

12. The controller of claim 11, wherein the processing circuitry is configured to:

determine that the user interface has not received the user input; and select the recommended fallback temperature sensor as the selected fallback temperature sensor in response to determining that the user interface has not received the user input.

13. The controller of claim 11, wherein the controller comprises a thermostat of the HVAC system, wherein the thermostat comprises an integrated temperature sensor, and wherein the user interface is configured to present the recommended fallback temperature sensor by presenting the integrated temperature sensor to the user as the recommended fallback temperature sensor.

14. The controller of claim 11, wherein the user interface is configured to receive the user input indicating that the user has not selected the recommended fallback temperature sensor as the selected fallback sensor temperature, and wherein the processing circuitry is configured to:

cause the user interface to present indications of other temperature sensors of the plurality of temperature sensors in response to determining that the user has not selected the recommended fallback temperature sensor as the selected fallback temperature sensor; and cause the user interface to prompt the user to select the fallback temperature sensor from the other temperature sensors.

15. The controller of claim 10, wherein the processing circuitry is further configured to:

determine that a new temperature sensor has been added to the plurality of temperature sensors, and cause the user interface is configured to prompt the user whether the new temperature sensor should be the fallback temperature sensor in response to determining that the new temperature sensor has been added to the plurality of temperature sensors.

16. The controller of claim 10, wherein the user input indicates two or more fallback temperature sensors from the plurality of temperature sensors based on the user input, wherein the processing circuitry is configured to determine the temperature at the fallback temperature sensor by determining temperatures at the two or more fallback temperature sensors based on communication between the controller and the two or more fallback temperature sensors, and wherein the processing circuitry is configured to control the HVAC system by controlling the HVAC system based on an average value of the temperatures at the two or more fallback temperature sensors in response to detecting no occupancy in the plurality of spaces.

17. A controller for a heating, ventilation, and air conditioning (HVAC) system in a building, the controller comprising:

a user interface configured to:

prompt a user to choose a fallback temperature sensor from a plurality of temperature sensors by at least presenting an indication of a recommended fallback temperature sensor to the user; and receive user input indicating a selected fallback temperature sensor from the plurality of temperature sensors in the building after prompting the user, wherein the plurality of temperature sensors in the building are associated with a plurality of spaces within the building; and processing circuitry configured to:

determine that the plurality of spaces within the building are unoccupied;

determine a temperature sensed by the selected fallback temperature sensor based on communication between the controller and the selected fallback temperature sensor; and cause the HVAC system to turn on or off based on the temperature at the selected fallback temperature sensor in response to determining that the plurality of spaces within the building are unoccupied.

18. A controller for a heating, ventilation, and air conditioning (HVAC) system in a building, the controller comprising:

a user interface configured to receive user input indicating a fallback temperature sensor from a plurality of temperature sensors in the building, wherein the plurality of temperature sensors in the building are associated with a plurality of spaces within the building; and processing circuitry configured to:

determine that a new temperature sensor has been added to the plurality of temperature sensors;

cause the user interface is configured to prompt a user whether the new temperature sensor should be the fallback temperature sensor in response to determining that the new temperature sensor has been added to the plurality of temperature sensors;

determine that the plurality of spaces within the building are unoccupied;

determine a temperature sensed by the fallback temperature sensor based on communication between the controller and the fallback temperature sensor; and cause the HVAC system to turn on or off based on the temperature at the fallback temperature sensor in response to determining that the plurality of spaces within the building are unoccupied.

19. The controller of claim 17, wherein the processing circuitry is configured to:

determine that the user interface has not received the user input; and select the recommended fallback temperature sensor as the selected fallback temperature sensor in response to determining that the user interface has not received the user input.

20. The controller of claim 17, wherein the controller comprises a thermostat of the HVAC system, wherein the thermostat comprises an integrated temperature sensor, and wherein the user interface is configured to present the recommended fallback temperature sensor by presenting the integrated temperature sensor to the user as the recommended fallback temperature sensor.

* * * * *